US006923026B1

(12) United States Patent
Clarke

(10) Patent No.: US 6,923,026 B1
(45) Date of Patent: Aug. 2, 2005

(54) METHOD FOR HAND-CRAFTING A RUG

(76) Inventor: Daisy M. Clarke, 1061 Sheridan St., Detroit, MI (US) 48214

( * ) Notice: Subject to any disclaimer, the term of this patent is extended or adjusted under 35 U.S.C. 154(b) by 0 days.

(21) Appl. No.: 10/994,882

(22) Filed: Nov. 23, 2004

(51) Int. Cl.[7] ..... D04B 9/00
(52) U.S. Cl. ..... 66/8; 66/170; 66/198
(58) Field of Search ..... 66/1 R, 1 A, 118, 66/169 R, 170, 198; 289/1.5, 1.2, 16.5, 18.1; 28/140, 143–145, 159, 163

(56) References Cited

U.S. PATENT DOCUMENTS

| | | | | | |
|---|---|---|---|---|---|
| 1,424,458 | A | | 8/1922 | Fleisher | |
| 2,357,750 | A | * | 9/1944 | McConnell | 66/170 |
| 3,886,768 | A | * | 6/1975 | Anderson | 66/195 |
| 3,893,310 | A | * | 7/1975 | Palfy | 66/169 R |
| 4,182,527 | A | | 1/1980 | Meehan | |
| 4,375,197 | A | | 3/1983 | Hinson | |
| 4,413,847 | A | | 11/1983 | Doyel | |
| 4,533,163 | A | | 8/1985 | Rosenberg | |
| 4,651,620 | A | | 3/1987 | Lyons | |
| 4,841,607 | A | * | 6/1989 | Sekino | 28/160 |
| 6,314,769 | B1 | * | 11/2001 | Brandenburg | 66/198 |

* cited by examiner

*Primary Examiner*—Danny Worrell

(57) ABSTRACT

A method for hand-crafting a rug includes obtaining a first sock loop and twisting the first sock loop to form one loop four strands thick. A second sock loop is pushed halfway through the one loop and a new sock loop is pushed through the two end loops of the second sock loop. Additional sock loops are drawn through selected socks and through each other. This step is repeated until a chain is formed. Another sock loop is wrapped around the chain and pushed through one of the additional sock loops. A new one of the successive sock loops is pushed through the first sock loop and a newer one of the successive sock loops is pushed through a space closest to the old loop. The old loop is pushed over the new successive loop until reaching an opposite end of the chain.

15 Claims, 6 Drawing Sheets

METHOD FOR HAND-CRAFTING A RUG

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a decorative rug and, more particularly, to a method for hand-crafting a rug.

2. Prior Art

The popular craft of rug making has been practiced by many people for a number of years. It provides an enjoyable pastime and creative outlet while producing useful and aesthetically appealing rugs having an infinite variety of designs and textures which cannot be duplicated by commercial machineproduced rugs. Handcrafted rugs are used on the floor in place of conventional floor coverings, and are often displayed as a wall hanging.

An apparatus for making yarn rugs semi-automatically is available in commerce. Such an apparatus is transported over the canvas by a manual drive, each piece of yam being folded in the middle and inserted between two threads of the canvas so that it forms a loop and the two ends of the piece stand out above the canvas. After all pieces of yam have been inserted, a coat of glue is applied to the underside of the canvas. One disadvantage of this prior art apparatus is that the individual pieces of yam are not knotted to the canvas but glued to it. Such glued rugs feel hard to the touch and may suffer damage under the influence of dampness. Furthermore this method of making a rug requires the use of an apparatus that must be purchased.

In an alternate method, a hand-operated knotting device is described whereby pieces of yarn already cut to the proper length are individually knotted to the canvas. A drawback of this apparatus is that working speed is only about twice as great as in the case of knotting solely by hand.

Most rug making techniques, including those described above, require a certain aptitude and many people find the techniques difficult to master. The usual methods of producing a hooked rug, for example, require some degree of skill and dexterity in order to achieve uniform spacing and density of the pile and to form the pile of a uniform height. Also, many people find the pushing or pulling of the hook through the backing fabric to be tiresome.

Accordingly, a need remains for a method for handcrafting a rug in order to overcome the above-noted shortcomings. The present invention satisfies such a need by providing a method that is easy to complete, has entertainment value, and gives pride to the user in the beauty of their completed rug. Such a method results in decorative items that can be displayed throughout the house and become interesting conversation pieces. The method is easily learned and completed by individuals with little or no crafting experience, thus making it accessible to all. Such a method will further provide a relaxing means to create attractive gifts, thus pleasing the recipient and the maker.

BRIEF SUMMARY OF THE INVENTION

In view of the foregoing background, it is therefore an object of the present invention to provide a method for hand-crafting a rug. These and other objects, features, and advantages of the invention are provided by a method for hand-crafting a rug including the following steps.

Obtain a first sock loop that has a predetermined diameter and twist the first sock loop to form two small loops. Subsequently twist such first sock loop again to form one loop that is four strands thick.

Next, push a second sock loop halfway through the one loop to thereby define two end loops. Push a new sock loop through the two end loops of the second sock loop and repeat this step a selected number of times to form a chain including a selected number of sock loops wherein a width of the chain is preferably defined by nine sock loops. The sock loops may have alternating colors for advantageously providing a unique pattern as desired by an operator.

Draw an additional n umber of sock loops through one of the selected sock loops of the chain in the previous step. Selectively draw the additional sock loops through each other in a successive manner and in a clockwise direction beginning with a middle one of the additional sock loops. The additional number of sock loops preferably equals three loops. Such additional sock loops are defined as A, B and C loops wherein loop B is pulled through loop A and loop C is pulled through loop B.

Next, wrap another sock loop around the chain and push the same sock loop through one of the additional sock loops. Such another sock loop defines an old loop after being pushed through one of the additional sock loops.

Repeat the previous step, wherein successive ones of the additional sock loops define a new loop until reaching an end of the chain.

At this point, push a new one of the successive sock loops through the first sock loop and put a latest one of the additional sock loops over the new successive sock loop.

Now, flip the chain so that the new successive sock loop and the latest additional sock loop switch positions from left to right and from right to left respectively. Such a chain includes oppositely disposed edge portions for defining a rounded outer edge and a braided inner edge respectively. Push a newer one of the successive sock loops through a space closest to the old loop and take the old loop over the new successive loop until reaching an opposite end of the chain. Repeat the last three steps until the rug has a desired length and width.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
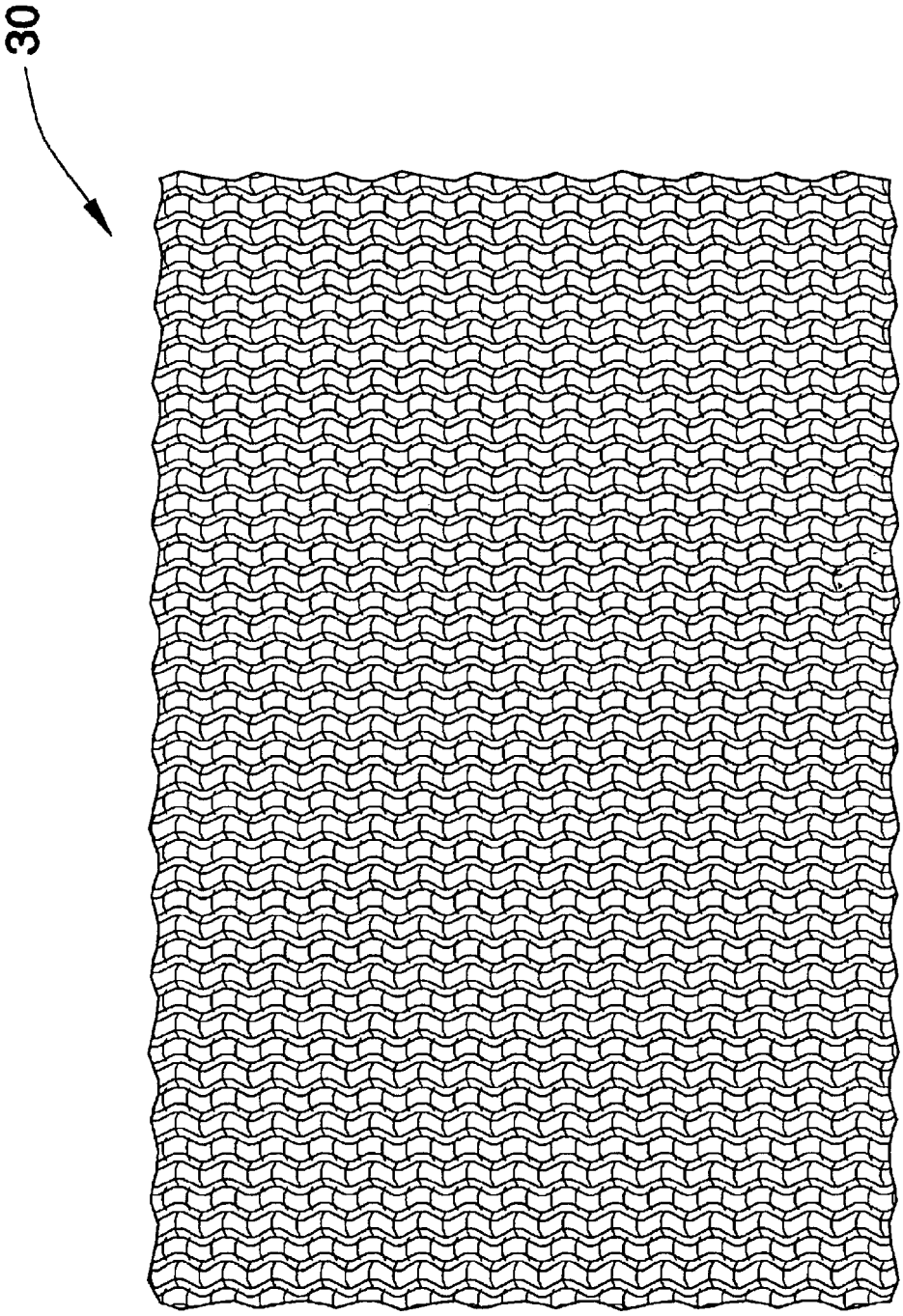
FIG. 1 is a top plan view showing a rug made by a method for handcrafting a rug, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The method of this invention is referred to generally in FIGS. 1–13 by the reference numeral 10 and is intended to provide a method for hand-crafting a rug. It should be understood that the method 10 may be used to hand craft many different types of rugs and tapestries and should not be limited to only bathroom rugs.

Figure 2:
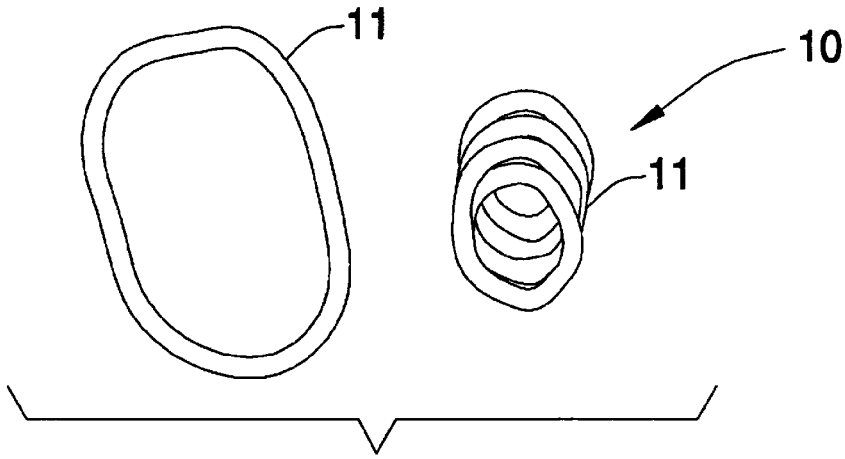
FIG. 2 is a perspective view showing a first sock loop and its twice twisted state.

Referring initially to FIG. 2, the method 10 includes obtaining a first sock loop 11 that has a predetermined diameter and twisting the first sock loop 11 to form two small loops. Subsequently, the first sock loop 11 is twisted again to form one loop that is four strands thick.

Figure 3:
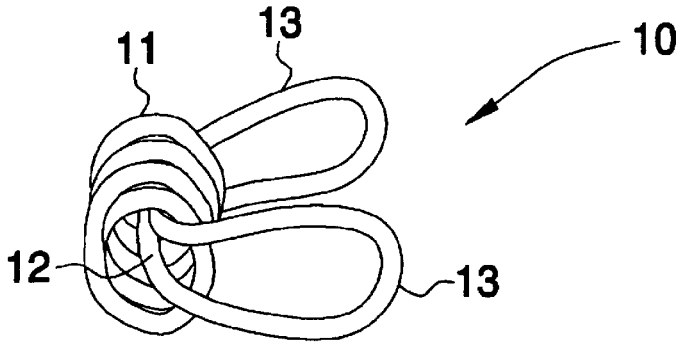
FIG. 3 is perspective view showing the second sock loop passed halfway through the twisted sock loop.
Figure 4:
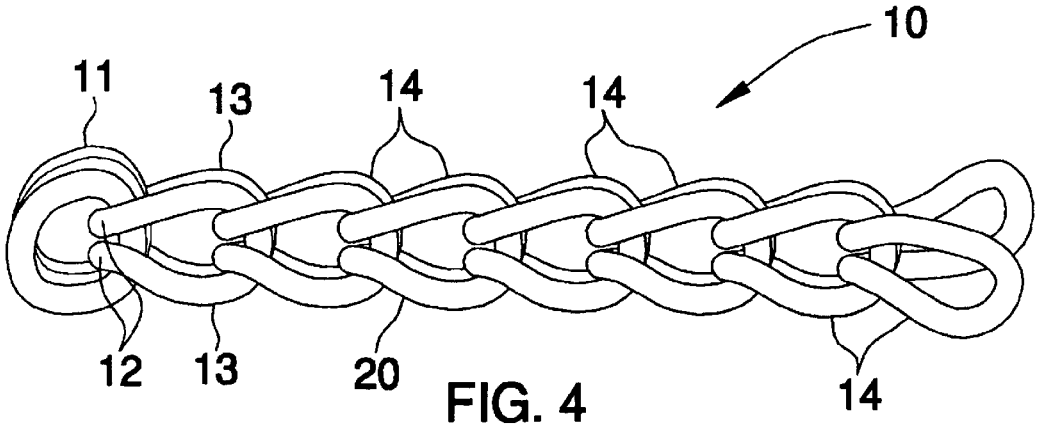
FIG. 4 is a side elevational view showing the new sock loops passed through the second sock loop.

Referring to FIGS. 3 and 4, a second sock loop 12 is pushed halfway through the one loop 11 to thereby define two end loops 13. A new sock loop 14 is then pushed through the two end loops 13 of the second sock loop. This step is repeated a selected number of times to form a chain 20 including a selected number of sock loops 14 wherein a width of the chain 20 is defined by nine sock loops 14. The sock loops 14 may have alternating colors for advantageously providing a unique pattern as desired by an operator.

Figure 5:
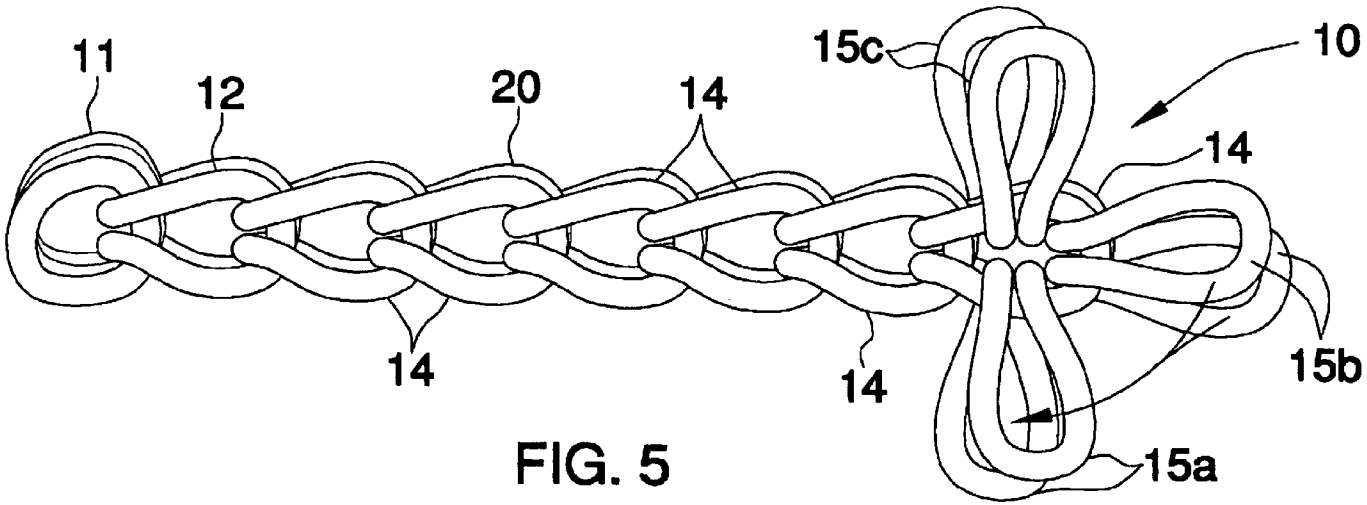
FIG. 5 is a side elevational view showing the additional sock loops drawn through a selected one of the new sock loops.
Figure 6:
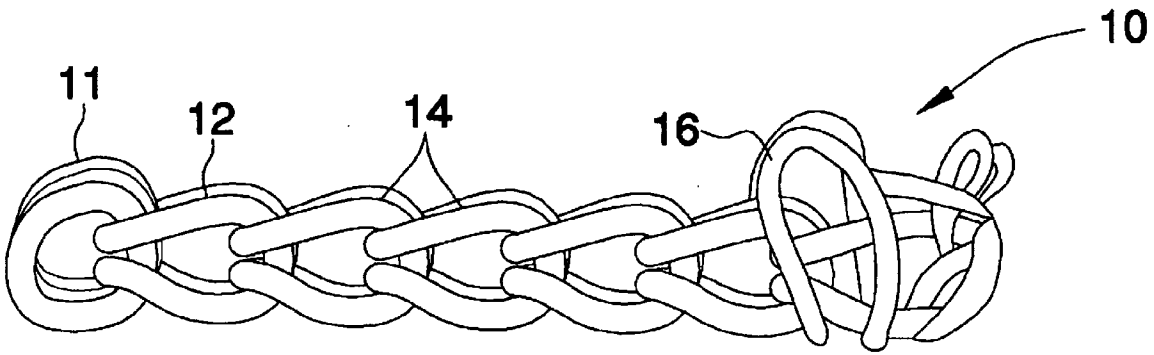
FIG. 6 is a side elevational view showing the additional sock loops drawn through each other.

Referring to FIGS. 5 and 6, an additional number of sock loops 15 are drawn through one of the selected sock loops 14 of the chain 20 in the previous step. The additional sock loops 15 are drawn through each other in a successive manner and in a clockwise direction beginning with the middle one 15B of the additional sock loops 15. The additional number of sock loops 15 equal three loops. Such additional sock loops 15 are defined as 15A, 15B and 15C loops wherein loop 15B is pulled through loop 15A and loop 15C is pulled through loop 15B.

Figure 7:
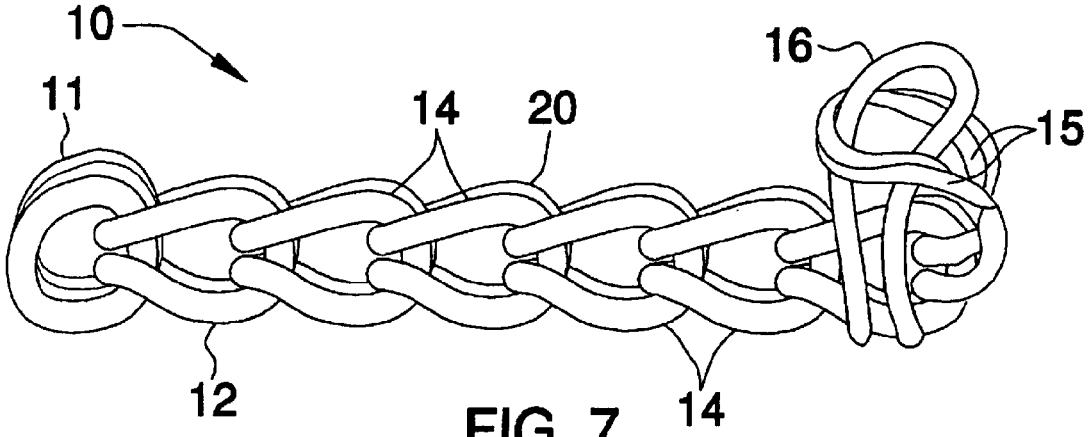
FIG. 7 is a side elevational view showing the newly wrapped sock loop pushed through the additional sock loops.

Referring to FIGS. 6 and 7, another sock loop 16 is wrapped around the chain 20 and the same sock loop 16 is pushed through one of the additional sock loops 15. Such another sock loop 16 defines an old loop after being pushed through one of the additional sock loops 15.

Figure 8:
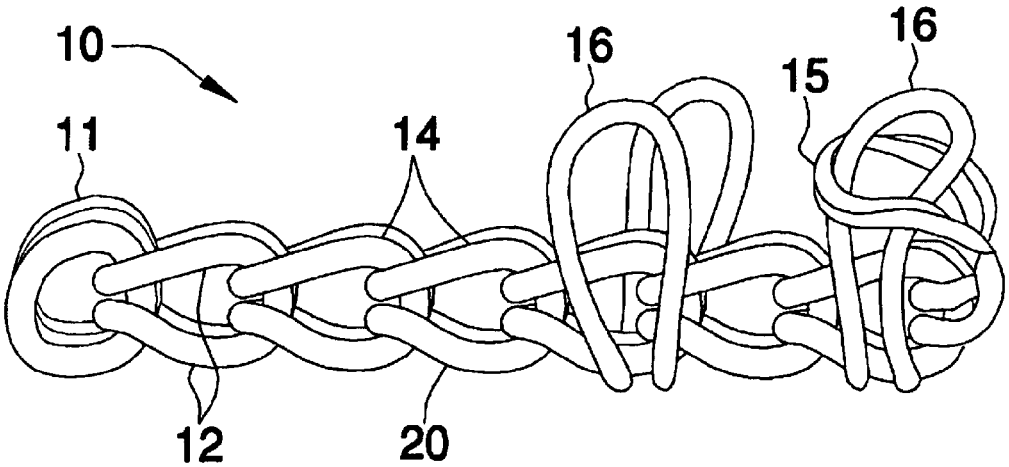
FIG. 8 is side elevational view of the step shown in FIG. 7, with another new sock loop.

Referring to FIGS. 6, 7 and 8, the previous step is repeated wherein successive ones of the additional sock loops 15 define a new loop until reaching an end of the chain 20.

Figure 9:
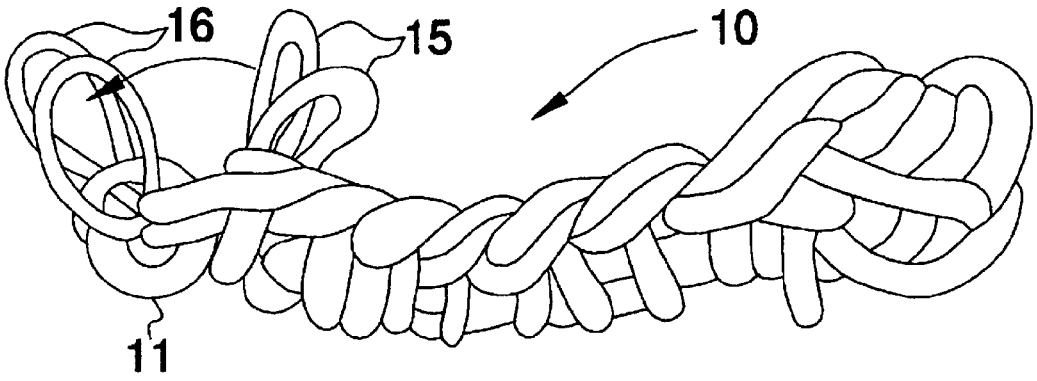
FIG. 9 is a side elevational view showing the a new sock loop being pushed through the first sock loop.
Figure 10:
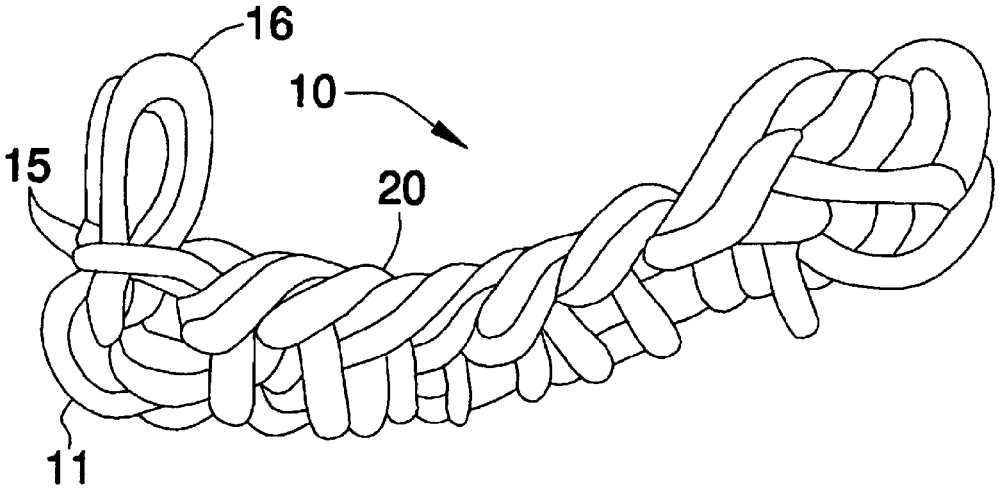
FIG. 10 is a side elevational view showing the loops prior to flipping.
Figure 11:
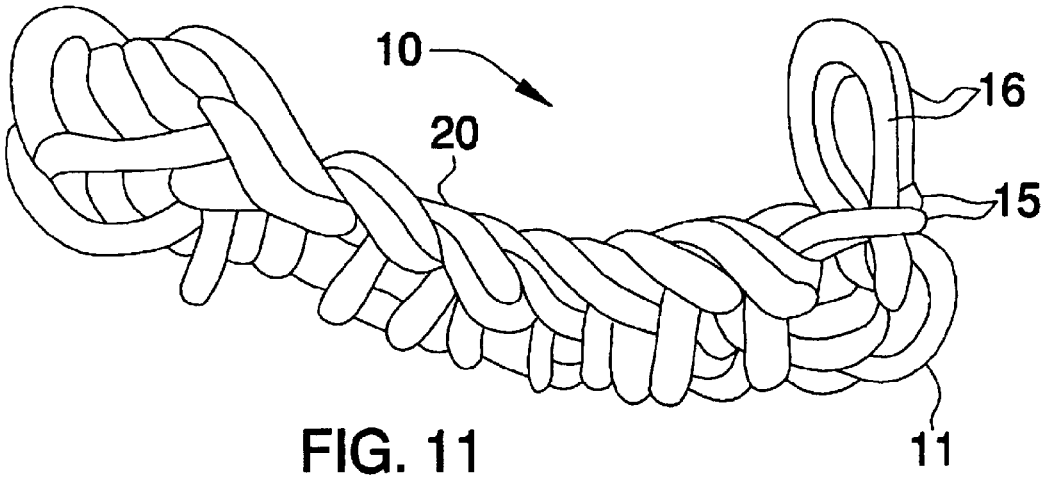
FIG. 11 is a side elevational view showing the loops after flipping, where the new successive sock loop and the latest additional sock loop switch positions.
Figure 12:
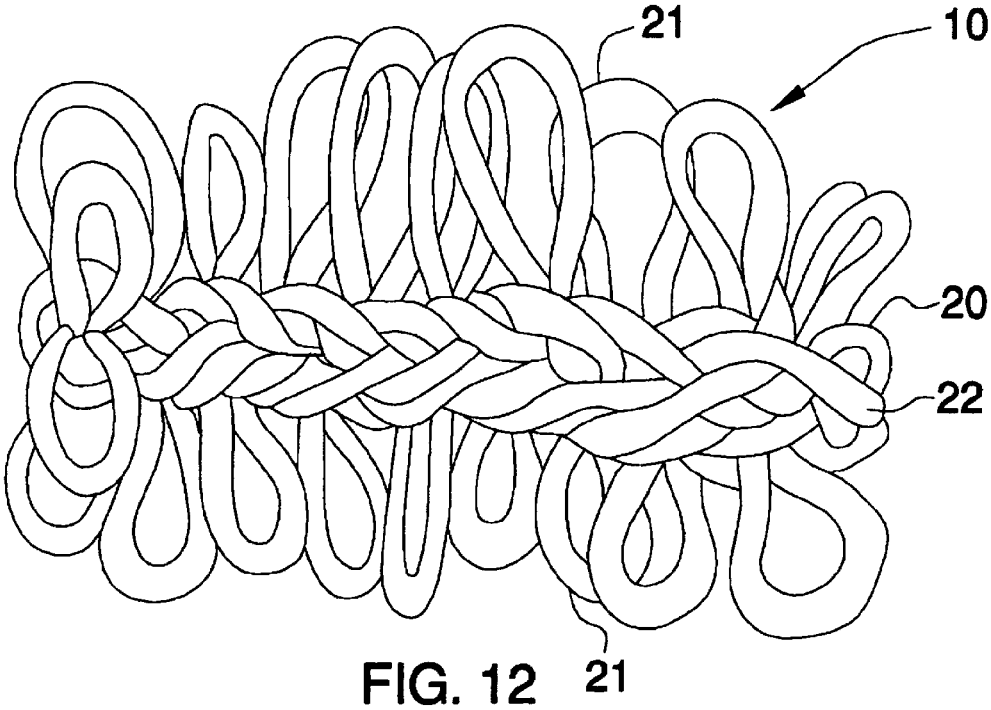
FIG. 12 is a top plan view showing a chain of sock loops.
Figure 13:
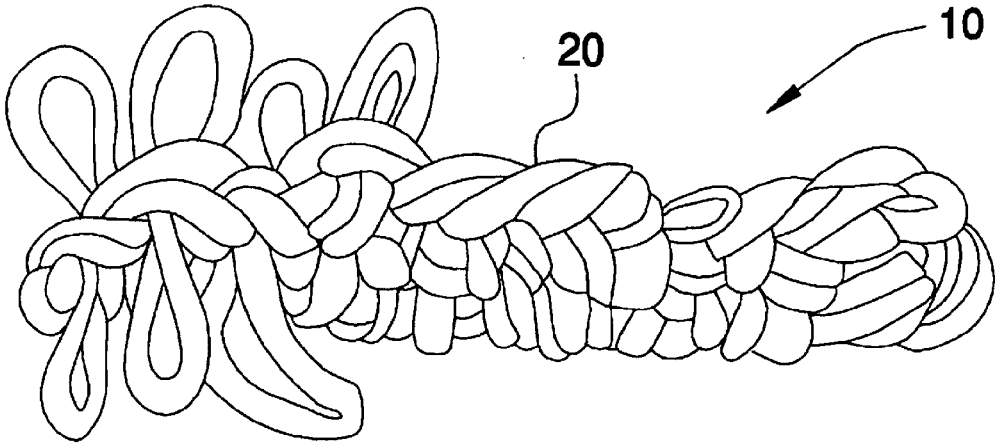
FIG. 13 is a side elevational view of the chains shown in FIG. 12, wherein selected ones of the sock loops have been knotted according to the method described be the present invention.

Referring to FIG. 9, at this point, a new one of the successive sock loops 16 is pushed through the first sock loop 11 and a latest one of the additional sock loops 15 is put over the new successive sock loop 16.

Referring to FIGS. 1, 10, 11, 12 and 13, the chain 20 is flipped so that the new successive sock loop 16 and the latest additional sock loop 15 switch positions from left to right and from right to left respectively. Such a chain 20 includes oppositely disposed edge portions for defining a rounded outer edge 21 and a braided inner edge 22 respectively. A newer one of the successive sock loops 16 is pushed through a space closest to the old loop and the old loop is taken over the new successive loop 16 until reaching an opposite end of the chain 20. The last three steps are repeated until the rug 30 has a desired length and width. Such a completed rug 30 may now be displayed in the crafter's house or be given as a thoughtful gift to a loved one in order to commemorate a special event or memory. The quickly and easily learned method 10 described herein above can provide hours of entertainment for people of all ages and, unlike most forms of entertainment these days, the end result can be cherished for a long time to come. Such a completed rug 30 can make a young child feel special and realize that they can accomplish tasks as long as they set their mind to it. Retired individuals can make rugs to sell and not feel that they are only a burden on society.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A method for hand-crafting a rug comprising the steps of:

(a) obtaining a first sock loop having a predetermined diameter and twisting said first sock loop to form two small loops;

(b) twisting said first sock loop again to form one loop four strands thick;

(c) pushing a second sock loop halfway through said one loop to thereby define two end loops;

(d) pushing a new sock loop through said two end loops of said second sock loop;

(e) repeating step (d) a selected number of times to form a chain including a selected number of sock loops;

(f) drawing an additional number of sock loops through one said selected sock loops of said chain;

(g) selectively drawing said additional sock loops through each other in a successive manner;

(h) wrapping another sock loop around said chain and pushing said another sock loop through one said additional sock loops, said another sock loop defining an old loop after being pushed through said one additional sock loop;

(i) repeating step (h) wherein successive ones of said additional sock loops defining a new loop until reaching an end of said chain;

(j) pushing a new one of said successive sock loops through said first sock loop and putting a latest one of said additional sock loops over said new successive sock loop;

(k) flipping said chain so that said new successive sock loop and said latest additional sock loop switch positions from left to right and from right to left respectively;

(l) pushing a newer one of said successive sock loops through a space closest to said old loop and taking said old loop over said new successive loop until reaching an opposite end of said chain; and (m) repeating steps (j) through (l) until the rug has a desired length and width.

2. The method of claim 1, wherein said additional number of sock loops equals three, said additional sock loops being defined as A, B and C loops wherein loop B is pulled through loop A and loop C is pulled through loop B.

3. The method of claim 1, wherein a width of said chain is defined by nine sock loops.

4. The method of claim 1, wherein said chain comprises: oppositely disposed edge portions for defining a rounded outer edge and a braided inner edge respectively.

5. The method of claim 1, wherein said sock loops have alternating colors for providing a unique pattern as desired by an operator.

6. A method for hand-crafting a rug comprising the steps of:

(a) obtaining a first sock loop having a predetermined diameter and twisting said first sock loop to form two small loops;

(b) twisting said first sock loop again to form one loop four strands thick;

(c) pushing a second sock loop halfway through said one loop to thereby define two end loops;

(d) pushing a new sock loop through said two end loops of said second sock loop;

(e) repeating step (d) a selected number of times to form a chain including a selected number of sock loops;

(f) drawing an additional number of sock loops through one said selected sock loops of said chain;

(g) selectively drawing said additional sock loops through each other in a successive manner and in a clockwise direction;

(h) wrapping another sock loop around said chain and pushing said another sock loop through one said additional sock loops, said another sock loop defining an old loop after being pushed through said one additional sock loop;

(i) repeating step (h) wherein successive ones of said additional sock loops defining a new loop until reaching an end of said chain;

(j) pushing a new one of said successive sock loops through said first sock loop and putting a latest one of said additional sock loops over said new successive sock loop;

(k) flipping said chain so that said new successive sock loop and said latest additional sock loop switch positions from left to right and from right to left respectively;

(l) pushing a newer one of said successive sock loops through a space closest to said old loop and taking said old loop over said new successive loop until reaching an opposite end of said chain; and (m) repeating steps (j) through (l) until the rug has a desired length and width.

7. The method of claim 6, wherein said additional number of sock loops equals three, said additional sock loops being defined as A, B and C loops wherein loop B is pulled through loop A and loop C is pulled through loop B.

8. The method of claim 6, wherein a width of said chain is defined by nine sock loops.

9. The method of claim 6, wherein said chain comprises: oppositely disposed edge portions for defining a rounded outer edge and a braided inner edge respectively.

10.The method of claim 6, wherein said sock loops have alternating colors for providing a unique pattern as desired by an operator.

11. A method for hand-crafting a rug comprising the steps of:

(a) obtaining a first sock loop having a predetermined diameter and twisting said first sock loop to form two small loops;

(b) twisting said first sock loop again to form one loop four strands thick;

(c) pushing a second sock loop halfway through said one loop to thereby define two end loops;

(d) pushing a new sock loop through said two end loops of said second sock loop;

(e) repeating step (d) a selected number of times to form a chain including a selected number of sock loops;

(f) drawing an additional number of sock loops through one said selected sock loops of said chain;

(g) selectively drawing said additional sock loops through each other in a successive manner and in a clockwise direction beginning with a middle one of said additional sock loops;

(h) wrapping another sock loop around said chain and pushing said another sock loop through one said additional sock loops, said another sock loop defining an old loop after being pushed through said one additional sock loop;

(i) repeating step (h) wherein successive ones of said additional sock loops defining a new loop until reaching an end of said chain;

(j) pushing a new one of said successive sock loops through said first sock loop and putting a latest one of said additional sock loops over said new successive sock loop;

(k) flipping said chain so that said new successive sock loop and said latest additional sock loop switch positions from left to right and from right to left respectively;

(l) pushing a newer one of said successive sock loops through a space closest to said old loop and taking said old loop over said new successive loop until reaching an opposite end of said chain; and (m) repeating steps (j) through (l) until the rug has a desired length and width.

12. The method of claim 11, wherein said additional number of sock loops equals three, said additional sock loops being defined as A, B and C loops wherein loop B is pulled through loop A and loop C is pulled through loop B.

13. The method of claim 11, wherein a width of said chain is defined by nine sock loops.

14. The method of claim 11, wherein said chain comprises: oppositely disposed edge portions for defining a rounded outer edge and a braided inner edge respectively.

15. The method of claim 11, wherein said sock loops have alternating colors for providing a unique pattern as desired by an operator.

* * * * *